US006863601B1

(12) United States Patent
Wang

(10) Patent No.: US 6,863,601 B1
(45) Date of Patent: Mar. 8, 2005

(54) SAND-BELT FINISHING MACHINE HAVING LIFT DEVICE

(76) Inventor: Wang Tien Wang, No. 45, Yi Chang East Rd., Taiping, Taichung Hsien (TW), 411

( * ) Notice: Subject to any disclaimer, the term of this patent is extended or adjusted under 35 U.S.C. 154(b) by 0 days.

(21) Appl. No.: 10/678,123

(22) Filed: Oct. 6, 2003

(51) Int. Cl.[7] ..... B24B 21/00
(52) U.S. Cl. ..... 451/300; 451/303; 451/336
(58) Field of Search ..... 451/300, 303, 451/336; 83/435.2, 155, 881, 447; 198/861.1, 586, 463.3; 144/1.1, 2.1, 3.1, 245.1

(56) References Cited

U.S. PATENT DOCUMENTS 3,132,451 A * 5/1964 Kile ..... 451/300
3,394,501 A * 7/1968 Carlson et al. ..... 451/300
3,603,041 A * 9/1971 McDonald ..... 451/300
4,258,506 A * 3/1981 Robinson ..... 451/300
4,556,471 A * 12/1985 Bergman et al. ..... 204/298.41
4,719,721 A * 1/1988 Stump ..... 451/300
5,133,156 A * 7/1992 Arms et al. ..... 451/303
6,044,960 A * 4/2000 Cloud et al. ..... 198/493
6,405,769 B1 * 6/2002 Labrie ..... 144/3.1

* cited by examiner

*Primary Examiner*—M. Rachuba
(74) *Attorney, Agent, or Firm*—Charles E. Baxley

(57) ABSTRACT

A sand-belt finishing machine includes a main frame, at least one grinding device, a conveyor platform mounted between the grinding device and the main frame, and a lift device mounted between the conveyor platform and the main frame for adjusting the position of the conveyor platform. The lift device includes a propeller shaft, a shaft, a support plate, a driving rod, and a slide rod. Thus, the distance between the grinding devices and the conveyor platform can be adjusted arbitrarily by the lift device, so that the grinding devices can be used to grind workpieces of different thickness.

10 Claims, 4 Drawing Sheets

SAND-BELT FINISHING MACHINE HAVING LIFT DEVICE

BACKGROUND OF THE INVENTION

1. Field of the Invention

The present invention relates to a sand-belt finishing machine, and more particularly to a sand-belt finishing machine having a lift device that can be operated easily and conveniently, thereby facilitating the user operating the lift device.

2. Description of the Related Art

A conventional sand-belt finishing machine comprises two rollers, and a sand belt reeved around the two rollers for grinding a workpiece, such as a wooden board, placed on a conveyor platform. However, the thickness of the wooden board is not a constant, so that it is necessary to adjust the position of the conveyor platform so as to change the distance between the conveyor platform and the sand belt.

SUMMARY OF THE INVENTION

The primary objective of the present invention is to provide a sand-belt finishing machine having a lift device that can be operated rapidly, easily and conveniently, thereby facilitating the user operating the lift device.

Another objective of the present invention is to provide a sand-belt finishing machine having a lift device that has a simplified construction, thereby decreasing costs of fabrication.

A further objective of the present invention is to provide a sand-belt finishing machine, wherein the distance between the grinding devices and the conveyor platform can be adjusted arbitrarily by the lift device, so that the grinding devices can be used to grind workpieces of different thickness.

In accordance with the present invention, there is provided a sand-belt finishing machine, comprising:

- a main frame;
- at least one grinding device located above the main frame;
- a conveyor platform mounted between the grinding device and the main frame; and
- a lift device mounted between the conveyor platform and the main frame for adjusting the position of the conveyor platform, wherein the lift device includes:
- a propeller shaft mounted in the main frame and having a first end provided with a beveled gear;
- a shaft having a first end secured on a bottom face of the conveyor platform and a second end extended through the main frame;
- a support plate having a first end secured on the second end of the shaft and a second end provided with a threaded sleeve which has an inside formed with a screw bore;
- a driving rod engaged in the screw bore of the threaded sleeve and having a distal end provided with a beveled gear meshing with the beveled gear of the propeller shaft; and
- a slide rod having a first end secured on the bottom face of the conveyor platform and a second end extended through the main frame.

Further benefits and advantages of the present invention will become apparent after a careful reading of the detailed description with appropriate reference to the accompanying drawings.

DETAILED DESCRIPTION OF THE INVENTION

Figure 1:
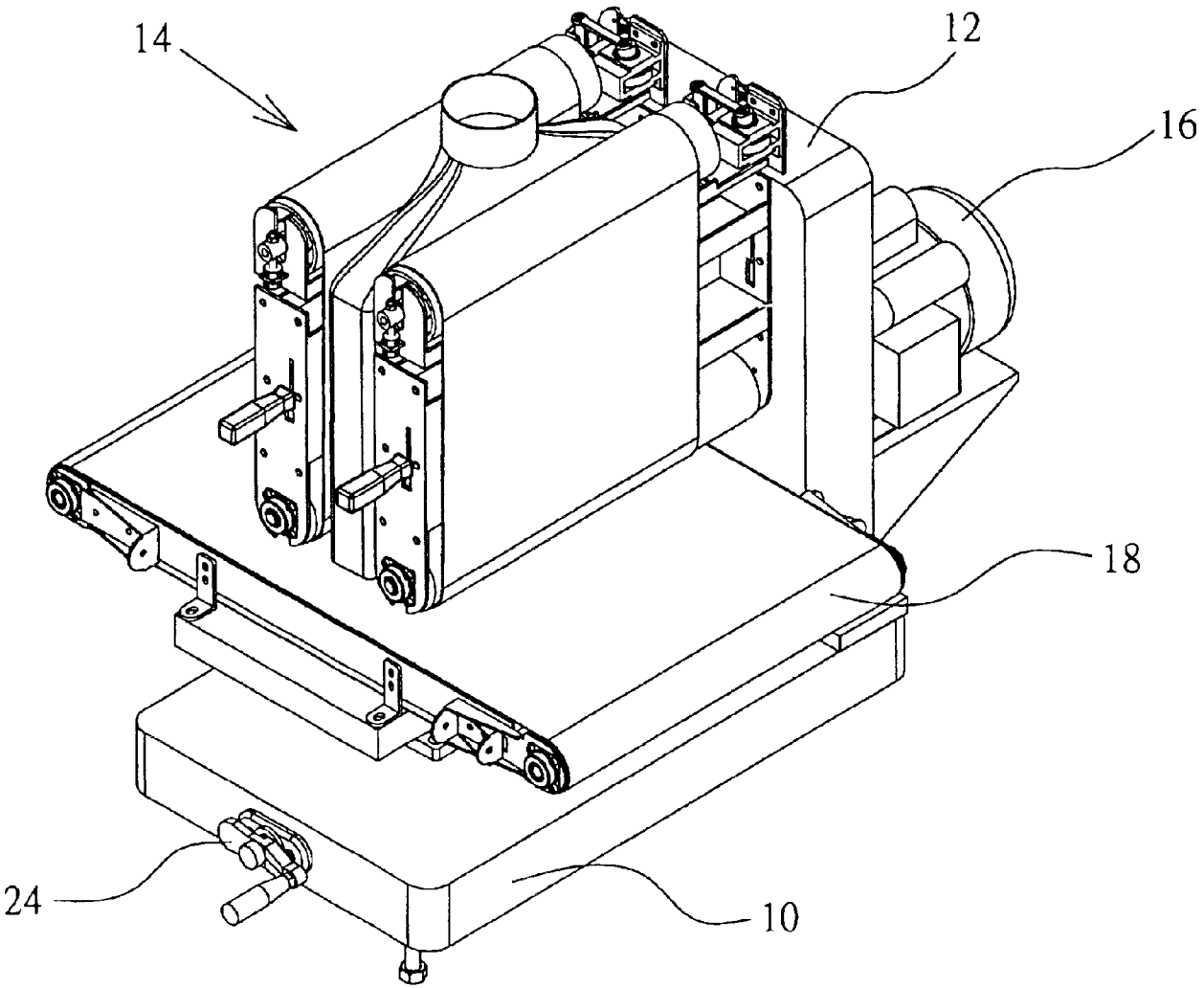
FIG. 1 is a perspective view of a sand-belt finishing machine in accordance with the preferred embodiment of the present invention.
Figure 2:
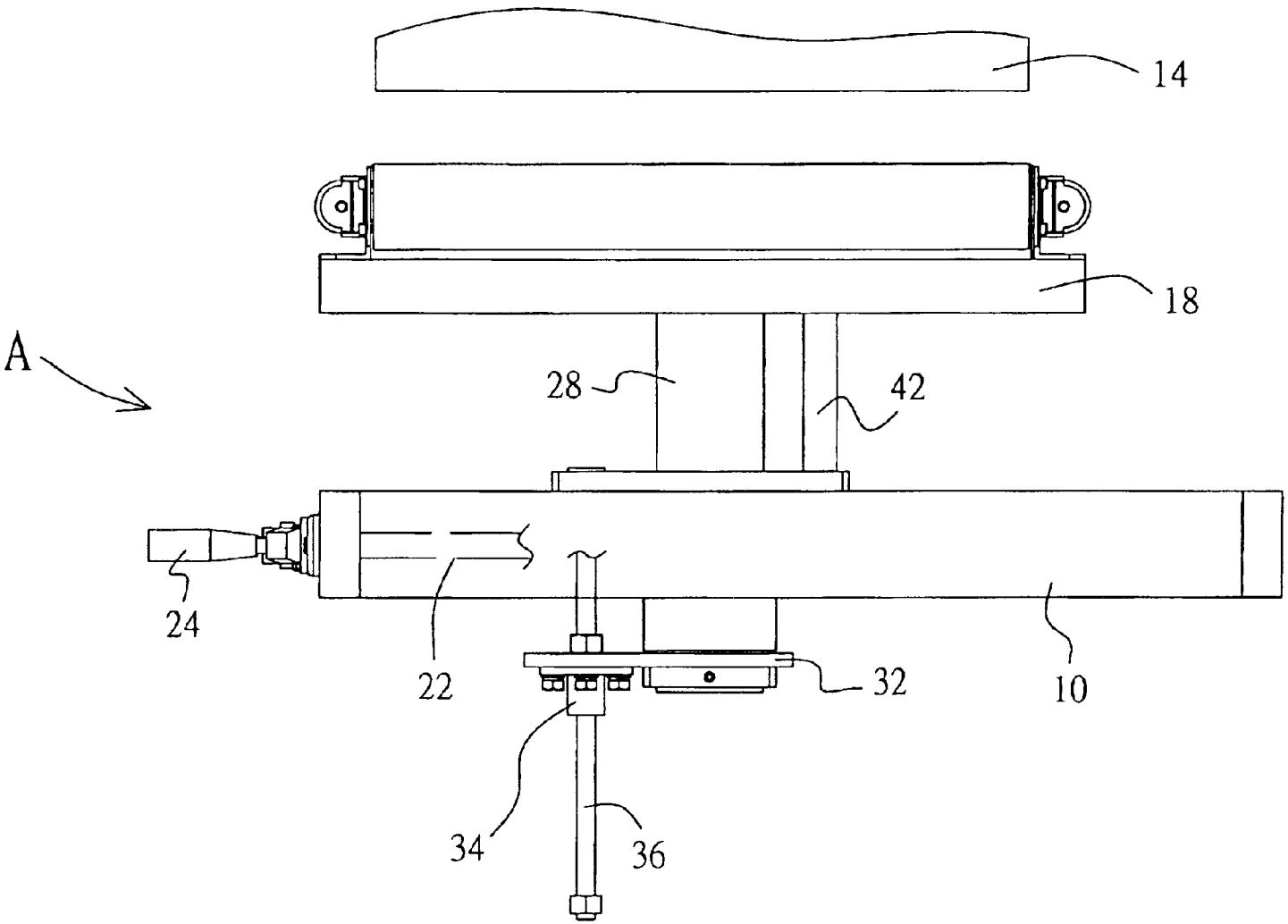
FIG. 2 is a partially cut-away side plan view of the sand-belt finishing machine as shown in FIG. 1.
Figure 3:
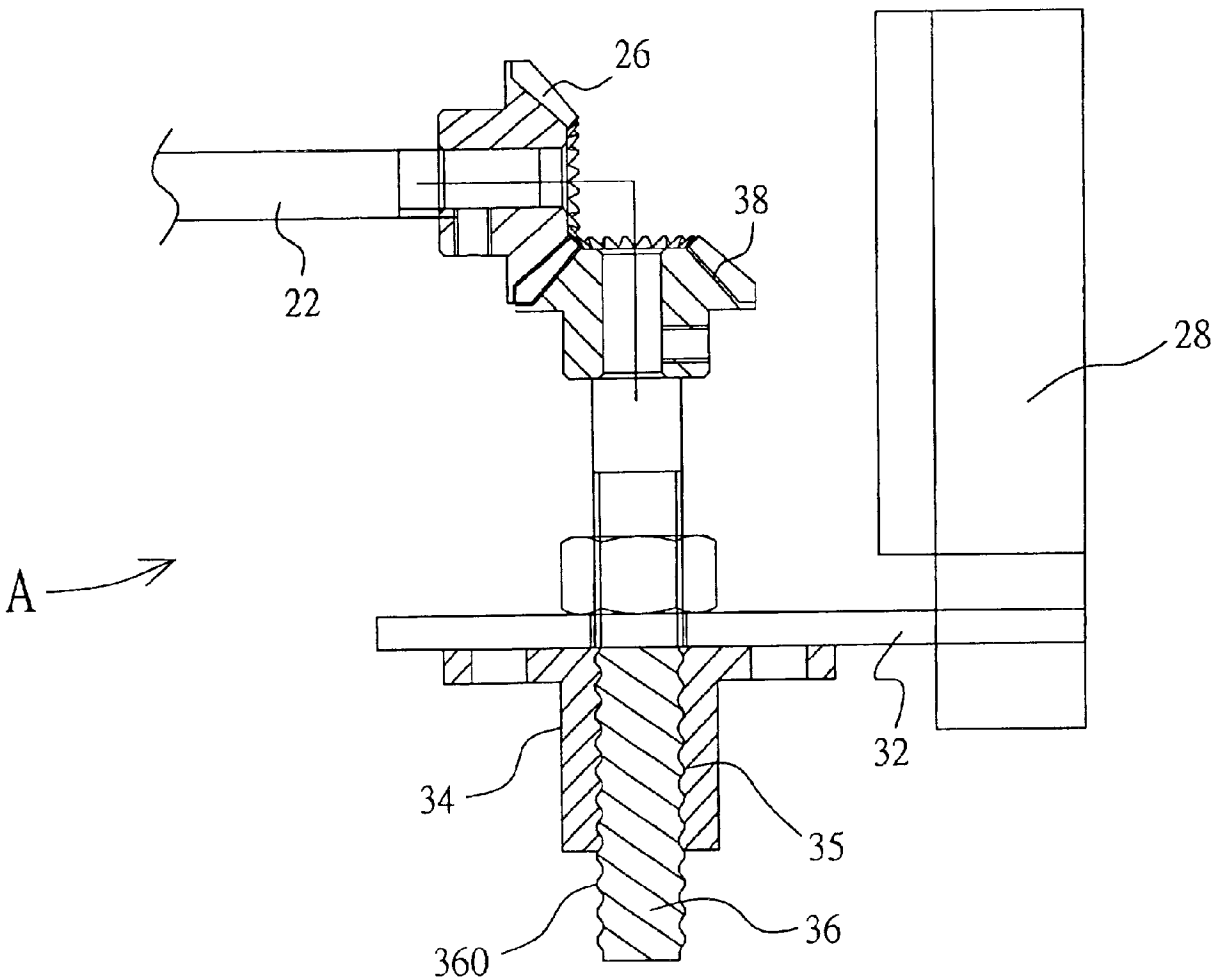
FIG. 3 is a partially cut-away enlarged cross-sectional view of the sand-belt finishing machine as shown in FIG. 2.

Referring to the drawings and initially to FIGS. 1–3, a sand-belt finishing machine in accordance with the preferred embodiment of the present invention comprises a main frame 10 disposed at a horizontal state, an upright seat 12 mounted on and vertical to the main frame 10, two grinding devices 14 mounted on the upright seat 12, a driving device 16 mounted on the upright seat 12 and connected to the grinding devices 14 for actuating the two grinding devices 14, a conveyor platform 18 mounted between the grinding devices 14 and the main frame 10, and a lift device "A" mounted between the conveyor platform 18 and the main frame 10 for adjusting the position of the conveyor platform 18.

The lift device "A" includes a propeller shaft 22 mounted in the main frame 10 and having a first end provided with a beveled gear 26 and a second end protruded outward from the main frame 10, and an operation handle 24 mounted on the main frame 10 and secured on the second end of the propeller shaft 22 for rotating the propeller shaft 22. Preferably, the beveled gear 26 is fixed on the first end of the propeller shaft 22.

The lift device "A" further includes a shaft 28 having a first end secured on a bottom face of the conveyor platform 18 and a second end extended through the main frame 10. Thus, the shaft 28 can be moved relative to the main frame 10.

The lift device "A" further includes a support plate 32 having a first end secured on the second end of the shaft 28 and a second end provided with a threaded sleeve 34. Preferably, the threaded sleeve 34 is fixed on the second end of the support plate 32 and has an inside formed with a screw bore 35.

The lift device "A" further includes a driving rod 36 engaged in the screw bore 35 of the threaded sleeve 34 and having a distal end provided with a beveled gear 38 meshing with the beveled gear 26 of the propeller shaft 22. The driving rod 36 is extended through the support plate 32. Preferably, the driving rod 36 has a periphery formed with an outer thread 360 screwed into the screw bore 35 of the threaded sleeve 34. In addition, the beveled gear 38 is fixed on the distal end of the driving rod 36.

The lift device "A" further includes a slide rod 42 having a first end secured on the bottom face of the conveyor platform 18 and a second end extended through the main frame 10. Preferably, the slide rod 42 is in parallel with the shaft 28. In addition, the slide rod 42 can be moved relative to the main frame 10.

Thus, the shaft 28 has a first end secured on the bottom face of the conveyor platform 18 and a second end extended through the main frame 10, and the slide rod 42 has a first end secured on the bottom face of the conveyor platform 18 and a second end extended through the main frame 10, so that the conveyor platform 18 is limited by the shaft 28 and the slide rod 42 without rotation.

In operation, referring to FIGS. 1–4, when the operation handle 24 is rotated, the propeller shaft 22 is rotated to rotate the beveled gear 26 which rotates the beveled gear 38 which rotates the driving rod 36, so that the threaded sleeve 34 screwed on the driving rod 36 can be moved upward and downward by rotation of the driving rod 36 so as to move the support plate 32 which moves the shaft 28 which moves the conveyor platform 18, so that the conveyor platform 18 can be thus moved upward and downward in a linear manner.

Thus, the conveyor platform 18 can be moved upward as shown in FIG. 2 so as to decrease the distance between the grinding devices 14 and the conveyor platform 18 for passage of a workpiece (not shown) of a smaller thickness, so that the grinding devices 14 can be used to grind the workpiece of a smaller thickness.

Figure 4:
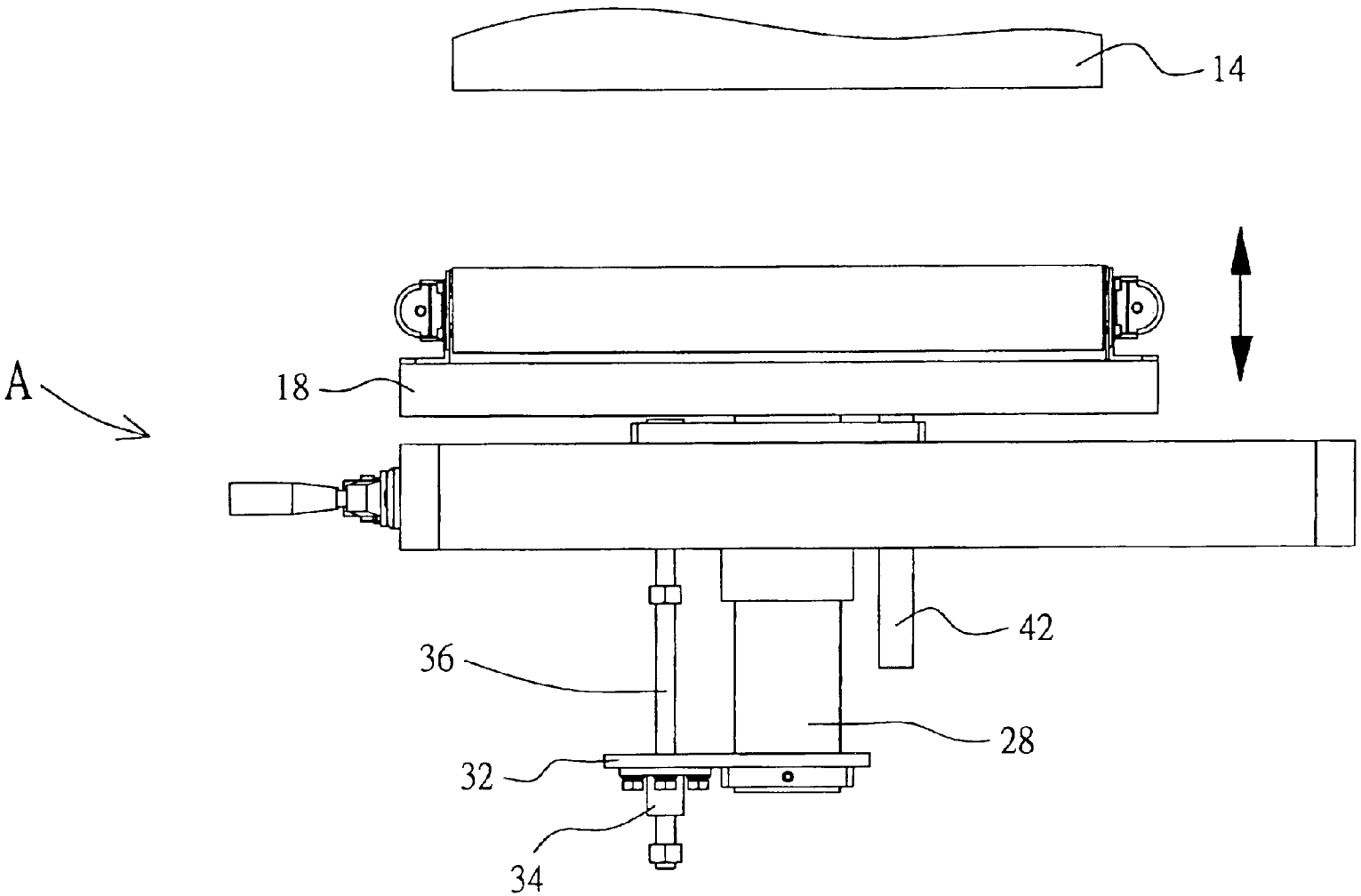
FIG. 4 is a schematic operational view of the sand-belt finishing machine as shown in FIG. 2.

Alternatively, the conveyor platform 18 can be moved downward as shown in FIG. 4 so as to increase the distance between the grinding devices 14 and the conveyor platform 18 for passage of a workpiece (not shown) of a greater thickness, so that the grinding devices 14 can be used to grind the workpiece of a greater thickness.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sand-belt finishing machine, comprising:

a main frame;

at least one grinding belt device located above the main frame;

a conveyor platform mounted between the grinding belt device and the main frame;

a lift device mounted between the conveyor platform and the main frame for adjusting a position of the conveyor platform, wherein the lift device includes:

a propeller shaft mounted in the main frame and having a first end provided with a beveled gear;

a driven shaft having a first end secured on a bottom face of the conveyor platform and a second end extended through the main frame;

a support plate having a first end secured on the second end of the driven shaft and a second end provided with a threaded sleeve which has an inside formed with a screw bore;

a driving rod engaged in the screw bore of the threaded sleeve and having a distal end provided with a beveled gear meshing with the beveled gear of the propeller shaft; and a slide rod having a first end secured on the bottom face of the conveyor platform and a second end extended through the main frame.

2. The sand-belt finishing machine in accordance with claim 1, wherein the propeller shaft has a second end protruded outward from the main frame, and the lift device further includes an operation handle rotatable mounted on the main frame and secured on the second end of the propeller shaft for rotating the propeller shaft.

3. The sand-belt finishing machine in accordance with claim 1, wherein the beveled gear of the propeller shaft is fixed on the first end of the propeller shaft.

4. The sand-belt finishing machine in accordance with claim 1, wherein the driven shaft is movable relative to the main frame.

5. The sand-belt finishing machine in accordance with claim 1, wherein the threaded sleeve is fixed on the second end of the support plate.

6. The sand-belt finishing machine in accordance with claim 1, wherein the driving rod is extended through the support plate.

7. The sand-belt finishing machine in accordance with claim 1, wherein the driving rod has a periphery formed with an outer thread screwed into the screw bore of the threaded sleeve.

8. The sand-belt finishing machine in accordance with claim 1, wherein the beveled gear of the driving rod is fixed on the distal end of the driving rod.

9. The sand-belt finishing machine in accordance with claim 1, wherein the slide rod is in parallel with the driven shaft.

10. The sand-belt finishing machine in accordance with claim 1, wherein the slide rod is movable relative to the main frame.

* * * * *